US006512169B1

(12) United States Patent
Santini

(10) Patent No.: US 6,512,169 B1
(45) Date of Patent: Jan. 28, 2003

(54) COMBINATION MARACA-GUIRO MUSICAL INSTRUMENT

(76) Inventor: Luis A. Santini, Calle 1 # 49 Hermanas Davala, Bayamon, PR (US) 00959

( * ) Notice: Subject to any disclaimer, the term of this patent is extended or adjusted under 35 U.S.C. 154(b) by 0 days.

(21) Appl. No.: 09/633,980

(22) Filed: Aug. 8, 2000

(51) Int. Cl.[7] ..... G10D 13/08

(52) U.S. Cl. ..... 84/402; 84/427.4; 446/418; 446/419

(58) Field of Search ..... 84/402, 427.4; D21/406; 446/418, 419

(56) References Cited

U.S. PATENT DOCUMENTS 1,495,672 A * 5/1924 Cheney ..... 84/422.4
1,509,956 A * 9/1924 Kipp ..... 84/402
2,318,460 A * 5/1943 Brief ..... 46/193
2,644,890 A * 7/1953 Hollihan ..... 250/71
3,319,507 A * 5/1967 Wolcott ..... 84/375
D244,635 S * 6/1977 Cohen ..... D17/4
4,200,026 A * 4/1980 Phreaner ..... 84/422 S
4,306,485 A * 12/1981 Rudkin ..... 84/402
5,044,250 A * 9/1991 Beyer ..... 84/422.4
5,199,920 A * 4/1993 Christen ..... 446/419
5,659,143 A * 8/1997 Isackson ..... 84/402
D431,044 S * 9/2000 Santini ..... D17/22
6,162,979 A * 12/2000 Gauger ..... 84/422.4

* cited by examiner

*Primary Examiner*—Kim Lockett
(74) *Attorney, Agent, or Firm*—Joe Chalverus

(57) ABSTRACT

A hand-held, gourd based percussion instrument, has a modified guiro gourd with two maraca gourds extended outwardly therefrom. A hollow, elongate guiro gourd is modified by having its ends removed and replaced with light-bulb shaped maracas with the spherical portions extending outwardly, the maracas attached by means of an extended member within the cylindrical center of the guiro. With sounding furrows on the outer surface of the cylindrical center and sounding pebbles within, the furrows are stroked with a rasper and the instrument is shaken to produce rhythmic sounds.

6 Claims, 3 Drawing Sheets

COMBINATION MARACA-GUIRO MUSICAL INSTRUMENT

CROSS-REFERENCES TO RELATED APPLICATIONS

Applicant received a design patent under this same title for the ornamental features of this invention D 431,044 granted Sep. 19, 2000.

BACKGROUND OF THE INVENTION

1.Field of the Invention

The present invention relates generally to hand held percussion musical instruments and more particularly to gourd type percusive instruments having outside rasping elements and a plurality of sounding pebbles or pits within and more specifically to gourd type percussive instruments constructed by a combination of two different types of gourds to produce a unique and particular quality of useful sound, hand-rasped and rhythmically moved at the same time.

2.Description of the Related Art

The "maraca," "guiro" and "candungo" are rhythmic percussion instruments made from gourds, generally spherical to light-bulb shaped dried wooden fruits. The maraca is a gourd made from the dried wooden fruit of the higuera tree, grown in tropical areas of the world. The candungo is made from the dried wooden fruit of the curcubitaceas tree having a spherical-like shape, that is the candungo shape has no blunt or horn shaped end. The marimbo is made from the dried wooden fruit of the curcubitaceas tree having two elongated ends. The guiro is a wooden dried fruit of the curcubitadeas tree having a blunt end and an elongated end. For all these musical instruments, generally, perforations are made through the outer wooden shell of these fruits after they are permitted to fully dry. The interior pulp is removed and replaced with small sounding pebbles or dried pits to be rattled within. A handle is often attached near or at the perforation areas of the dried fruit. Furrowed parallel indentations with regular striation patterns are cut into an area of the outer surface of the instrument somewhat centered between the ends. A comb-like rasper is then used to grate upon the striation pattern to produce according to the pressure and strokes employed and together with the rattled sounding pebbles, a unique and complex sound.

While similar in construction the sound from the maraca and the sound of the guiro are distinct, each producing unique and complex sounds when played. A person knowledgeable in these sounds can distinguish the sounds made from the maraca as compared to the guiro. Each one however is limited to its unique sound produced in exclusion to the sound of the other. In other words, to have both sounds, each instrument must be present and played. There is therefor, a need for another type of percussive instrument that produces its own unique sound, with the sound properties of both the maraca and guiro when played.

Known hand-held percussive instruments includes U.S. Pat. No. 2,318,460 to Samuel Brief on May 4, 1943 to describe a duel maraca removable mounted to a centrally elongated handle. The handle is uninvolved with the sound qualities that would be desirable. U.S. Pat. No. 4,306,485 to Alan Rudkin on Dec. 22, 1981 describes an elongated cylindrical multichambered percussion instruments with frusto-conical ends, confined free-flowing spherical bead members to produce rhythmic sounds when the instrument is shaken. U.S. Pat. No. 5,659,143 to Nadene Isackson on Aug. 19, 1997 describes a generally cylindrically shaped metallic central member with end diaphragms, the instrument containing metal particles, the size of the particles and diaphragms tuned to provide its superior percussive effects. Nevertheless, the instruments above described fail to adequately provide the time tested superior sound produced by the dried fruits of the malanga or the guiro.

BRIEF SUMMARY OF THE INVENTION

My invention combines the advantages of the maraca and the guiro into a single instrument to produce an even more pleasing sound than either the maraca or the guiro while combining the qualities of the sound of each instrument further having the advantage that only one player is needed to produce the combination sound of the maraca and guiro. I do this by combining the center portion of a guiro with two maracas complete with sounding pebbles, each attached to an end of the modified guiro. The center portion of the invention is furrowed with a pattern of regular striation on the outer surface for receiving rasper grates. When completed according to my specification this combination instrument sounds very different from either the maraca or the guiro while retaining the desirable sounds of each.

Accordingly, it is a general object of the present invention to provide an improved rhythmic instrument.

More specifically, it is an object of the present invention to provide a rhythmic instrument having the pleasing sounds produced by a guiro and the pleasing sounds produced by a maraca.

It is also an object to provide a combination rhythmic instrument combining the maraca and the guiro into a single instrument that can be played by a single person yet provide the attractive musical sounds of both instruments.

It is another object of the present invention to attain the foregoing objects and also to provide an improved percussive, rhythmic instrument that can be constructed easily and conveniently without the need for complicated tools yet withstand routine playing, handling and moving from one location.

Further objects and advantages of my invention will become apparent from a consideration of the drawings and ensuing description thereof.

DESCRIPTION OF THE PREFERRED EMBODIMENTS

Figure 1:
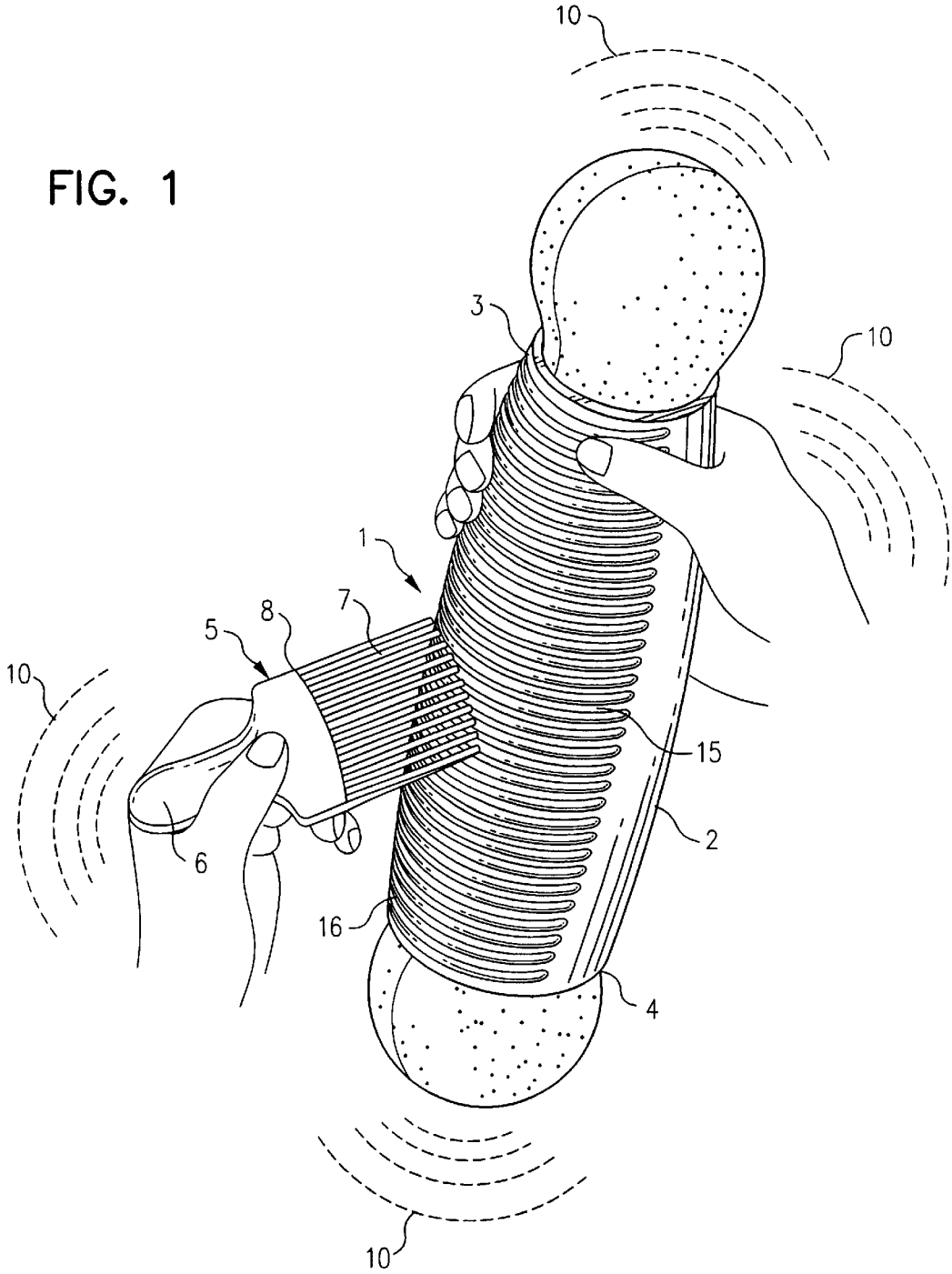
FIG. 1. is a perspective of the instrument in use.
Figure 2:
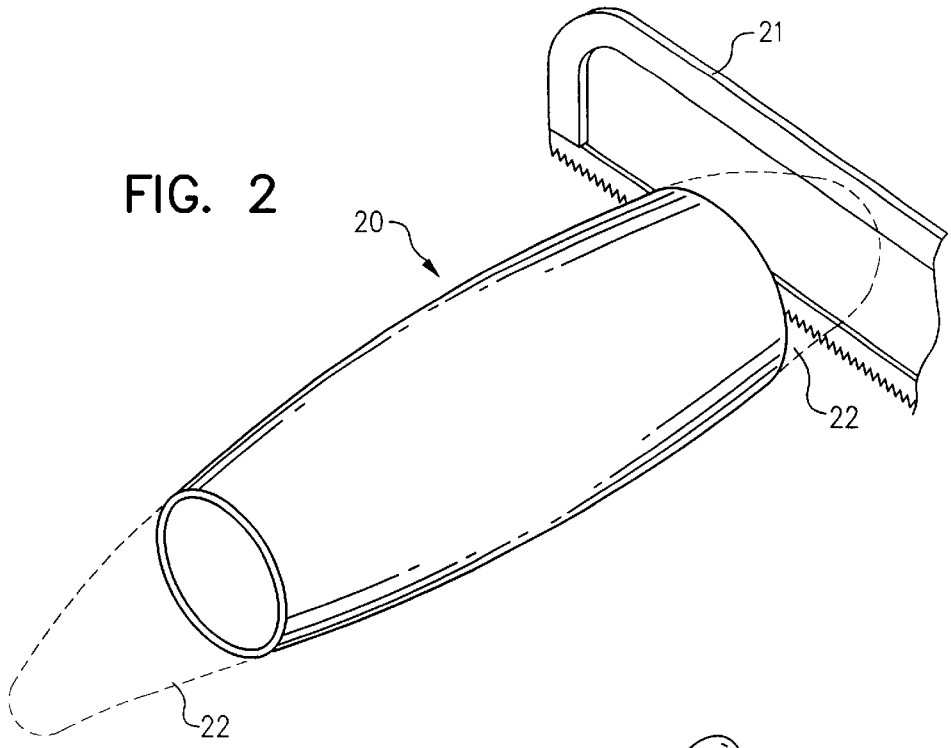
FIG. 2. is perspective of the construction of the central element.
Figure 4:
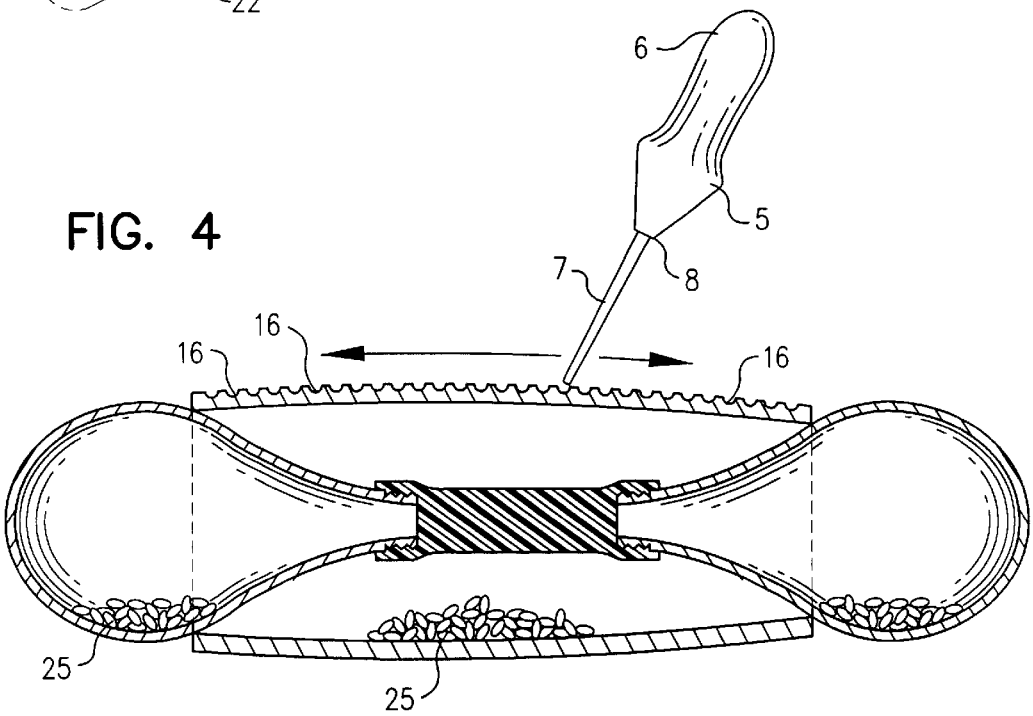
FIG. 4. is a side view of the elements of the invention.
Figure 3:
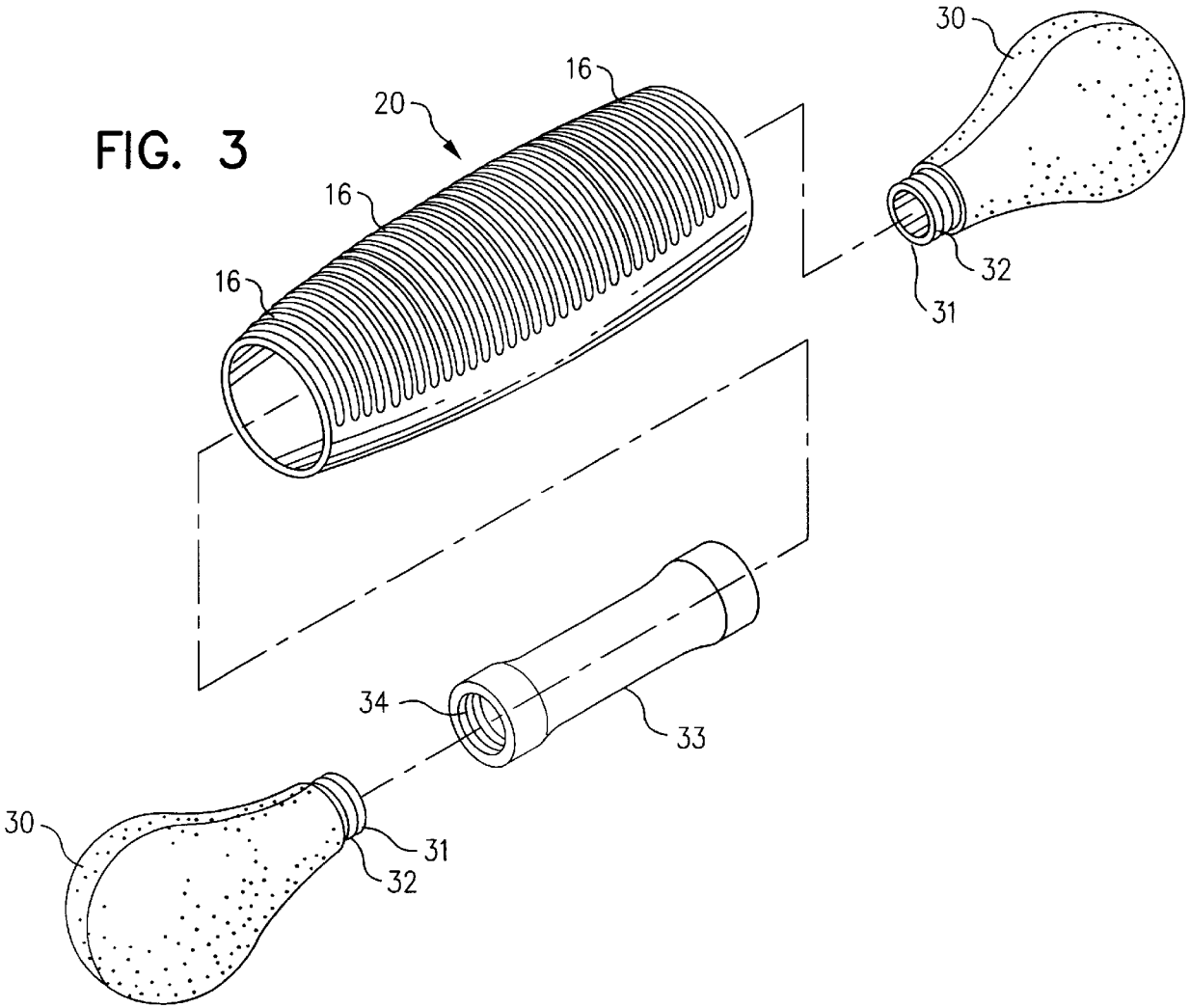
FIG. 3. is an isometric view of the instrument featuring the inside elements of the invention.

Viewing FIG. 1, the hand held instrument generally designated as 1 is used in combination with a hand held rasper 5 used to stroke the instrument 1 where indicated and by moving the instrument 1 rhythmically as indicted by the curved broken lines 10. As can be appreciated by users of these types of percussive instruments, the rasper 5 is scraped across the central area indicated as 15 to produce one of the components of the sound. Indentations 16 have been regularly chiseled or otherwise cut onto the area 15 the surface of the instrument being careful to not penetrate the entire wooden shell. While the area shown in this set of FIGS. 1, 3 and 4 show that the furrowed groves or indentations 16 occupy a portion 15 of the center element 2, from one end 3 to the other end 4 of the center portion of the center element 2, the area of striations 15 need not occupy this much area of the instrument. The instrument 1 is also shaken as is also indicated by the broken lines 10 to impel small pebbles 25 within the instrument to move and percuss upon the inside surfaces of the hollow instrument 1, best shown by FIG. 4.

To make the instrument, a mature fruit from a curcubitadeas tree is set aside to dry for a time determined by the size and age of the fruit. When the guiro 20 is hard, the surface has a hard or wood quality and nearly empty. The whole guiro will have a cylindrical-like shape in the center portion with a blunt end and an elongated end, both indicated as 22. These ends 22 are removed from the center cylindrical portion 20 by cutting means, shown here by use of a saw 21 removing the ends 22 outlined here in dotted lines. Whatever residue within the fruit is discarded. The best guiros will not show any signs of damage or rot and the cut edges will be smooth without signs of splitting. Furrows 16 are cut into the surface of the center portion 20 of the guiro using a scoring tool or awe careful not to puncture the skin of the guiro 20. Parallel furrows 16 cut tangentially on the surface of the guiro are shown in FIG. 4 to be spaced from each other approximately the same as the depth of cut of the furrows 16.

Maracas are the dried fruit of a higuera tree. In general they are light-bulb shaped, that is, one end is spherical while the other end tapers to a blunt end. The ends of the instrument, are made from two dried maracas having approximately the same size. For each maraca, the blunt end is opened leaving the natural spherical end 30 with a portion of the tapered end 31 and the contents are removed by shaking. The tapered end is machined to have a outside thread 32. A joining tube 33 sized to reside within the guiro 20. This could be from stock piping available for plumbing in various lengths and diameters or tailored to the description given herein. The joining tube should have internal threads 34 matching the outside threads 32 of the maracas at both ends of the tube 33. I have found that one inch diameter plastic pipe stock having the appropriate length works well, the outside threads 32 cut to match the plastic pipe stock threads 34. Small pits, stones or pebbles 25 are first introduced into the guiro 20, then the joining tube 33 is used to attach the maracas 30 to the guiro as shown in FIG. 3. The maracas are simply threaded onto the ends of the pipe according to the thread 34 direction to close. The maracas 30 can be permanently attached using glue or fasteners if desired. In assembly of the maracas 20 to the guiro 20 using the joining tube 33, It is easiest to first attach one of the maracas to the joining tube 33, then insert it within the guiro 20, then attach the other maraca to the other end of the joining tube 33, tightening as may be needed to retain the maracas as shown in FIG. 4 to the guiro 20. Glue, if desired could be used at the threads 32 and 34.

The furrowed groves 16 may be cut into the surface of the center element 2 by cutting or carving into a regular pattern circumferentially along a portion of the instrument to compose the area 15. In this manner, by moving the rasper 5 across the furrowed groves 16, sound is produced and amplified by the hollow configuration of the instrument. The rasper 5 is generally, hand held has a plurality of prongs 7 attached midway 8 to a handle end 6 to extend in a parallel fashion from the handle end 6. The traditional rasper 5 is made of a wood handle 6 carved to comfortably accommodate the user's hand. The prongs 7 are generally cut from metal wire, then permanently attached at 8 and sized to flex when the rasper 5 is scraped across area 15 according the pressure imparted by the user, then return by the metal memory to its extended position. The intensity of the rasping sound is controlled by the user according to the pressure of the rasper 5 the user imposes when scraped across area 15. The length of sound produced is controlled by the user according to the speed the user to rasp the area 15, the longer sound produced by a slower speed while short sounds produced by a faster speed or rasping less area of the area 15 or a combination of the two. Short accent and rhythmic sounds can be produced by tapping the rasper onto the instrument, differing sounds produced by tapping differing parts of the instrument. The sound produced in combination with these techniques produces a pleasing rhythmic sound, usually to accompany other musical instruments and singing.

While the above description contains many specifications, there should not be construed as limitations on the scope of the invention, but rather as an exemplification of one preferred embodiment thereof. Many other variations are possible, for example: there are many other ways to join the maracas to the guiro, using pins, screws and the like. Further, the furrowed surface of the guiro 20 is seen here etched into the skin of the dried fruit, however, it is similarly possible to attach a furrowed board to the surface of the guiro 20. Not described here is the art of decorating the final instrument, which is customary in many places. Accordingly, the scope of the invention should be determined not by the embodiment illustrated, but by the appended claims and their legal equivalents.

I claim:

1. The method of making a combination maraca-guiro musical instrument used in combination with a rasper and sounding pebbles, the steps comprising:

selecting a dried fruit from a curcubitadeas tree having an elongated shape;

removing both ends of the fruit leaving a generally cylindrical shaped portion with open ends;

chiseling sounding furrows onto the outside surface of the cylindrical portion;

placing the sounding pebbles within the cylindrical portion;

selecting a pair of dried gourds from an higuera tree;

attaching the gourds to the ends of the cylindrical portion;

the instrument played by grating the rasper upon the sounding furrows while shaking the instrument to agitate the sounding pebbles.

2. The method of making the combination maraca-guiro musical instrument as described in claim 1 further comprising the steps of:

selecting the gourds having spherical shapes tapered to a blunt end, attaching the gourds to the ends of the cylindrical portion by the blunt ends.

3. A maraca-guiro musical instrument used with a rasper and sounding pebbles comprising:

a center portion of a guiro having a generally cylindrical shape;

sounding furrows etched on an outside surface of said center portion;

the pebbles placed inside the center portion;

an elongated joinder member having threaded ends;

a pair of spherical shaped maracas, each tapered to a blunt end;

threads on the blunt ends complementary to the threaded ends;

the maracas disposed at the ends of the center portion by the interaction of the threaded ends and threads on the blunt ends with the spherical shapes extending outwardly from the ends of said center portion;

the furrows stroked by the rasper and the instrument shaken to agitate the sounding pebbles.

4. The method of making a combination maraca-guiro musical instrument used in combination with a rasper and sounding pebbles, the steps comprising:

selecting a dried fruit from a curcubitadeas tree having an elongated shape;

removing both ends of the fruit leaving a generally cylindrical shaped portion with open ends;

chiseling sounding furrows onto the outside surface of the cylindrical portion;

placing the sounding pebbles within the cylindrical portion;

selecting a pair of dried gourds from an higuera tree, each gourd having a spherical shape tapered to a blunt end;

cutting threads on the ends of an elongated member;

cutting threads into the blunt ends of the gourds complementary to said thread on the ends of the member;

aligning said member within the cylindrical shaped portion with its ends extending outwardly;

threading the gourds onto the ends of the elongated member so that the spherical shape of each gourd extends outwardly forming said instrument;

the instrument played by grating the rasper upon the sounding furrows while shaking the instrument to agitate the sounding pebbles.

5. A maraca-guiro musical instrument used in combination with a rasper and sounding pebbles comprising:

a dried guiro with its ends removed leaving a generally cylindrical portion;

furrowed sounding ridges on the outer surface of the cylindrical portion;

a pair of dried maracas;

each maraca spherically shaped and tapered to a blunt portion, sounding pebbles within the cylindrical portion;

an elongated joiner member having threaded ends positioned within the cylindrical portion;

complementary threaded blunt portions on the maracas, the maracas attached to the threaded ends of said joiner member with the maracas positioned by the blunt portions to the ends of the cylindrical portion;

the rasper striking the farrowed sounding ridges while the instrument is shaken to produce sound.

6. The method of making a combination maraca-guiro musical instrument used in combination with a rasper and sounding pebbles, the steps comprising:

selecting a dried fruit from a curcubitadeas tree having an elongated shape;

removing both ends of the fruit leaving a generally cylindrical shaped portion with open ends;

chiseling sounding furrows onto the outside surface of the cylindrical portion;

placing the sounding pebbles within the cylindrical portion;

selecting a pair of dried gourds from an higuera tree having spherical shapes tapered to a blunt end;

cutting threads on the ends of an elongated member aligned within the cylinder, the ends extended outwardly;

cutting complementary threads to the blunt ends of the gourds;

threading the gourds onto the ends of the elongated member, the instrument played by grating the rasper upon the sounding furrows while shaking the instrument to agitate the sounding pebbles.

* * * * *